United States Patent [19]

Eberle

[11] Patent Number: 4,963,326

[45] Date of Patent: Oct. 16, 1990

[54] PROTECTIVE DEVICE FOR CAPILLARY TUBELETS

[75] Inventor: Gunter Eberle, Tuttlingen, Fed. Rep. of Germany

[73] Assignee: Firma Andreas Hettich, Tuttlingen, Fed. Rep. of Germany

[21] Appl. No.: 280,784

[22] Filed: Dec. 7, 1988

[30] Foreign Application Priority Data

Dec. 7, 1987 [DE] Fed. Rep. of Germany ... 8716160[U]

[51] Int. Cl.[5] ..... B01L 9/06; B01L 11/00; B04B 5/02

[52] U.S. Cl. ..... 422/101; 422/102; 422/104; 220/356; 494/16

[58] Field of Search ..... 215/320; 422/102, 104, 422/101; 220/356; 494/16, 85

[56] References Cited

U.S. PATENT DOCUMENTS 3,297,184 11/1963 Andelin ..... 215/320 X
4,591,486 5/1986 Eberle ..... 422/102 X

OTHER PUBLICATIONS

Fisher Scientific, 1986 Catalog, pp. 224–225 & 493.

*Primary Examiner*—Robert J. Warden
*Assistant Examiner*—Jeffrey R. Snay
*Attorney, Agent, or Firm*—Browdy & Neimark

[57] ABSTRACT

A protective device is provided for capillary tublets during centrifuging of blood by means of a centrifuge. The tubelets are placed on the disk of a centrifuge and pointed radially outwardly from the rotation axis of the disk in such a way the closed ends of the capillary tublets are directed towards a wall side of the disk. The protective device comprises a protective tube with a stopper. The tubelets are disposed in the protective tube. The stopper is propped against the disk wall of the disk of centrifuge during the centrifuging process.

4 Claims, 2 Drawing Sheets

PROTECTIVE DEVICE FOR CAPILLARY TUBELETS

FIELD OF THE INVENTION

The invention relates to a protective device for capillary tubelets during the centrifuging of blood by means of a centrifuge.

BACKGROUND OF THE INVENTION

Such capillary tubelets are thin glass tubes, closed at one end with sealing putty, which are filled with blood and are placed horizontally into receiving clips in a disk of a centrifuge. After centrifuging, it is possible to read off the ratio of erythrocytes to plasma on the basis of the layering in the capillary tubelet.

Such centrifuging devices using a horizontal rotor disk are known per se. In a known device the rotor disk forms a circumferential edge with a layer of rubber on the inside. A plurality of the capillary or hematocrit tubelets are fastened horizontally in receivers on the rotor disk and are pointing outwardly in the form of a star, the hematocrit tubelets with their ends closed by sealing putty being supported during centrifuging against the raised rubber edge of the rotor disk.

In a known device for centrifuging in accordance with German Patent DE-PS No. 30 13 122 a read-off device is additionally disposed on the rotor disk for reading off the exact height of the erythrocyte column by means of a magnifying glass from a scale disposed above the hematocrit tubelets after the rotor has stopped. Prior to this the rotor disk is fixed by means of a clamping device and the scale is calibrated by moving a read-off disk by means of an eccentric.

Such centrifuge devices do not have a separate protective device for the hematocrit tubelets, because of which the thin glass capillaries sometimes can break during the centrifuging. Glass splinters may disadvantageously soil the centrifuge disk or damage adjacent tubelets. Furthermore, the contents of the tubelets may exit in the form of an aerosol from the lid of the centrifuge, which is not pressure-sealed, because of which there is the danger of infection of the user, in particular in view of the danger of AIDS infection.

The steps, known per se, of pressure-sealing the light rotor by means of a hood and locking it are expensive in materials and money and multiply the cost of the apparatus.

SUMMARY OF THE INVENTION

It therefore is an object of the instant invention to improve a centrifuge with a rotor disk of the species mentioned so that increased safety of the hematocrit tubelets in respect to glass breakage is achieved and that soiling and the danger of infection is avoided even if the glass of the hematocrit tubelets should break.

To attain this object in a centrifuge with capillary tubelets inserted on the rotor disk, the characteristics of claim 1 are provided by the invention.

The essence of the invention thus lies in the provision of a separate protective device for each hematocrit tubelet in the form of a surrounding protective tube, wherein the protective tube and the hematocrit tubelet are disposed on the rotor disk with greater security because of the support by a common stopper. In particular, the hematocrit tubelet no longer is tightly clamped, but can move to a small degree within the protective tube. The common stopper acts as an additional resilient buffer to absorb the centrifugal forces acting on the hematocrit tubelets in the longitudinal direction. In particular, natural vibrations of the hematocrit tubelets which might occur at critical rpm are reduced this way, in the manner of an interspersed flexible or rigidly elastic member. In this way deformations of the longitudinal axis of the hematocrit tubelets during centrifuging, perhaps because of irregularities which might be present in the position of the glass, are cushioned because the hematocrit tubelets are supported at the inside of the protective tube during deviation of the longitudinal axis. If nevertheless breaking of the glass of the hematocrit tubelet should occur, emerging liquid and glass splinters are harmlessly caught by the protective tube.

In a preferred embodiment the stopper is cone-shaped in cross section with the cross section decreasing in the direction towards the wall of the disk and the stopper has an inner bore with an annular groove at the bottom surface for receiving the protective tube, a projection starting at the annular groove extending into the protective tube on which the sealed end of the hematocrit tubelet rests.

It is preferably provided that the inner bore of the stopper, beginning at the upper surface, narrows in the shape of a cone and that above the annular groove an annular lug-shaped support surface for the neck of the protective tube is formed.

In a further embodiment, recesses or circular receptacles for the stopper of the protective device are formed at the raised edge of the centrifuge disk.

Below, the invention will be described by means of the drawings showing only one type of embodiment. Further important characteristics and advantages of the invention can be seen from the drawings and the description.

The subject of the invention here present does not derive from the subjects of the individual claims alone, but also from the combination of the individual claims with each other.

All details and characteristics revealed in the application, including the abstract, in particular the spatial design shown in the drawings, are claimed as important for the invention to the extent that they are novel in respect to the state of the art, either by themselves or in combination.

DESCRIPTION OF THE DRAWINGS

In FIG. 1 a known centrifuge with a horizontal centrifuge disk 2 for the determination of the hematocrit value of blood on the basis of plasma or hematocrit layering inside a capillary or hematocrit tubelet 27 is shown in a top view, partially in section.

In FIG. 1, a hematocrit tubelet 27 of a known type (in this case without a protective device) has been placed on the centrifuge disk 2 and is shown in FIG. 1 after centrifuging, an erythrocyte column 36 of a height 37 and, above it, a layered plasma column 35 with an upper point 30 having formed in the hematocrit tubelet.

Figure 1:
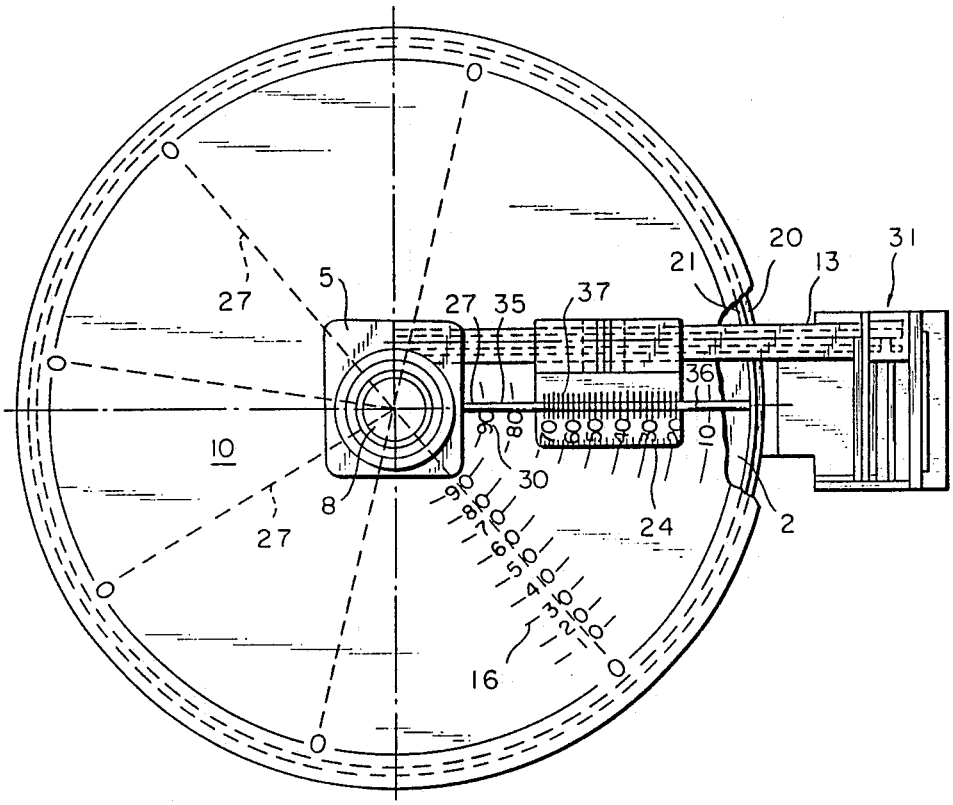
FIG. 1 is a top view of a known centrifuge with a horizontal centrifuge disk with hematocrit tubelets inserted, without a protective device, but with a read-off device for the determination of the hematocrit value.

A read-off disk 10 with a scale 16 is displaced via an eccentric, not shown here, by means of an adjusting knob 8, for reading off the hematocrit value in such a way that the value 100 on the scale 16 coincides with the upper point 30 of the plasma column 35, as shown in FIG. 1.

Then, by means of the read-off magnifying glass 24 the exact hematocrit value of the blood can be determined by the height 37 of the erythrocyte column 36. The read-off magnifying glass 24 is disposed on a guide rod 13 which is supported on a housing 5 and is held on the outside by a clamping device 31 in which the centrifuge disk 2 is clamped to fixed parts of the centrifuge for the read-off. The read-off magnifying glass can be moved on the guide rod 13 as needed in order to read off in this way the height 37 in relation to the scale 16.

In this known device according to FIG. 1 the hematocrit tubelets 27 are disposed in the shape of a star at fixed distances on the centrifuge disk 2 and are in particular inserted or clamped into receptor clips or clamps, not shown in detail, which extend from the centrifuge disk 2 in such a way that essentially areas at the top and at the bottom of the hematocrit tubelets 27 are clampingly secured.

The hematocrit tubelets 27 are supported in the direction of the radially outward action of the centrifugal force at the raised edge 20 of the centrifuge disk 2, in particular at a rubber edge 21, also raised, because of which glass breakage of the hematocrit tubelets 27 is avoided to a large degree from the start, even without a protective device, in this known centrifuge device.

Figure 2:
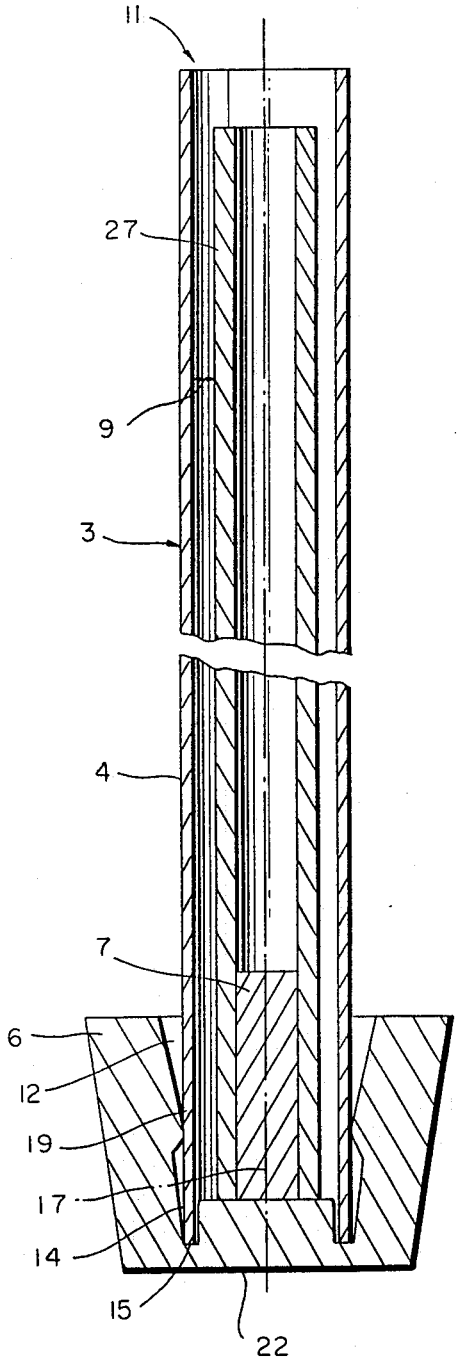
FIG. 2 is a hematocrit tubelet with a protective tube and a stopper as protective device for placement on a centrifuge disk in accordance with FIG. 1.

A protective device 3 is provided in accordance with FIG. 2, in order to further reduce glass breakage and, should glass breakage nevertheless occur, in order to avoid soiling and infection, comprising in particular a protective tube 4 with a stopper 6, with a capillary or hematocrit tubelet 27 loosely inserted into the protective tube 4.

The protective tube 4 with the stopper 6 and including the hematocrit tubelet 27 inserted into the protective tube 4 is used in a simple manner in a centrifuge in accordance with FIG. 1, i.e. according to FIG. 1, the protective tube 4 is inserted or clamped into the supports provided for the hematocrit tubelet 27 on the centrifuge disk 2, the stopper now being supported on the raised rubber edge 21.

The bottom 22 of the stopper 6 is then supported on the raised rubber edge 21. of the centrifuge disk. The rubber edge 21 may be straight or it is possible to provide on the rubber edge 21 radially inwardly pointing circular receptacles for the stopper 6, or the rubber edge 21 may have circular recesses into which the stopper 6 is inserted at least partially and where it rests increasingly secure during centrifuging.

The stopper is advantageously made of a resilient material so that the oscillations of the hematocrit tubelet 27 and of the protective tube 4 are absorbed in the manner of a buffer, in particular in connection with the resilient rubber edge 21 of the edge 20 of the centrifuge disk 2.

The centrifuging operation in connection with the protective device 3 takes place as follows:

The hematocrit tubelets 27 are filled from their open end with blood and are inserted into the protective tube 4 from the upper end 11 and are placed on the stopper 6.

The protective device 3, consisting of the protective tube 4 with the stopper 6 and including the filled hematocrit tubelet 27, is now placed or clamped in accordance with FIG. 1 on the centrifuge disk 2 in place of the hematocrit tubelet 27 shown there. The hematocrit tubelets 27 inclusive of the protective tubes 4 are arranged in a star shape, the stoppers 6 of the protective device 3 each being supported at the raised rubber edge 21.

According with the representation in accordance with FIG. 1, a plasma column 35 and an erythrocyte column 36 are formed in the hematocrit tubelet 27 after centrifuging, the values of which are determined according to a scale 16, read off through the protective tube 4 by means of a read-off magnifying glass 24.

If glass breakage of the hematocrit tubelets 27 should occur, the contents and glass splinter collect in the protective tube 4 without soiling the centrifuge disk 2 or possibly damaging adjacent hematocrit tubelets 27. It is also important that the contents of the tubelets cannot escape in the form of an aerosol from the lid of the centrifuge which is not pressure-sealed.

There is no danger of breakage of the protective tube 4, because it has a larger diameter together with a lower weight and is furthermore advantageously maintained in the stopper 6 in the area of the annular groove 14 and the support surface 19. The inner bore 12 is cone-shaped starting at the upper surface of the stopper 6 in order to make it easier to insert the protective tube 4.

At the end of the centrifuging and read-off operations the protective tube 4 inclusive of the stopper 6 and the hematocrit tubelet 27 inserted in the protective tube 4 is removed from the centrifuge disk 2.

The hematocrit tubelet 27 can be removed from the protective tube 4 by simply tilting or by pulling off the stopper 6.

The stopper 6 may also be extruded on the protective tube 4 by means of injection molding.

I claim:

1. A combination of a capillary tubelet having a closed end and an open end and a protecting device for protecting said capillary tubelet from breakage or preventing danger of infection if said tubelet should break during centrifuging of blood, wherein said combination is placed on a disk of a centrifuge and pointed radially outwardly from the rotation axis of said disk in a manner such that said closed end of said capillary tubelet is directed toward a peripheral wall of said disk, said protecting device comprising;

a protective tube (4) having open ends; and a stopper (6) disposed against said peripheral wall of said disk, said capillary tubelet being contained within said protective tube and supported by said stopper, said stopper having an inner bore (12) with an annular groove (14), said groove receiving one of said open ends of said protective tube, and a projection extending from said annular groove into a portion of said protective tube at said one of said open ends, said projection providing a support for said closed end of said capillary tubelet.

2. A device in accordance with claim 1 wherein said stopper is cone-like in cross section and the cross section decreases in a direction toward the peripheral wall of said disk.

3. A device in accordance with claim 2 wherein the inner bore of the stopper narrows, beginning at a top portion thereof, in a cone-like manner; and wherein said inner bore comprises an annular lug-shaped support surface for supporting a neck portion of said protective tube and is formed above the annular groove.

4. A device in accordance with claim 3 wherein recesses for receiving the stopper of said combination are formed on said peripheral wall of the disk of said centrifuge.

* * * * *